US010428446B2

(12) United States Patent
Smith et al.

(10) Patent No.: US 10,428,446 B2
(45) Date of Patent: Oct. 1, 2019

(54) WOVEN FLAME-RESISTANT GARMENT FABRIC, AND GARMENT MADE THEREFROM

(71) Applicant: Milliken & Company, Spartanburg, SC (US)

(72) Inventors: Ansel L. Smith, Mooresville, NC (US); John E. Ashley, Spartanburg, SC (US); Rachel W. Boyette, Taylors, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 15/692,580

(22) Filed: Aug. 31, 2017

(65) Prior Publication Data

US 2017/0362749 A1 Dec. 21, 2017

Related U.S. Application Data

(63) Continuation of application No. 13/796,896, filed on Mar. 12, 2013, now abandoned.

(60) Provisional application No. 61/716,163, filed on Oct. 19, 2012.

(51) Int. Cl.

| | |
|---|---|
| ***D03D 15/12*** | (2006.01) |
| ***D02G 3/44*** | (2006.01) |
| ***A41D 31/08*** | (2019.01) |

(52) U.S. Cl.

CPC ..... *D03D 15/12* (2013.01); *A41D 31/08* (2019.02); *D02G 3/443* (2013.01); *D10B 2201/20* (2013.01); *D10B 2321/101* (2013.01); *D10B 2331/021* (2013.01); *D10B 2401/16* (2013.01); *Y10T 442/3984* (2015.04)

(58) Field of Classification Search

None

See application file for complete search history.

(56) References Cited

U.S. PATENT DOCUMENTS

2005/0097877 A1* 5/2005 Hainsworth ..... D03D 11/00 57/243
2010/0281923 A1* 11/2010 Zumloh-Nebe ..... D02G 3/045 66/174

FOREIGN PATENT DOCUMENTS

CA 2814640 A1 * 4/2012 ..... A41D 31/0027
WO WO-2011137213 A2 * 11/2011 ..... D02G 3/047

* cited by examiner

*Primary Examiner* — Chinessa T. Golden
(74) *Attorney, Agent, or Firm* — Robert M. Lanning

(57) ABSTRACT

A woven flame-resistant fabric for garments, the warp and fill yarns being made up of at least about 30 wt. % inherently flame-resistant fibers. The fabric is woven from a plurality of warp yarn groups consecutively arranged across the width direction in a recurring pattern, each warp yarn group consisting of a plurality of adjacent consecutively arranged warp yarns. At least one warp yarn in each warp yarn group is woven with the fill yarns in a plain (1/1) weave and at least one warp yarn in each warp yarn group is woven in one or more non-plain weaves each selected from the group consisting of 1/2, 2/1, 2/2, 1/3, and 3/1. Approximately half of the warp yarns in the fabric are woven in a plain (1/1) weave and the remaining warp yarns in the fabric are woven in the one or more non-plain weaves, in an alternating fashion.

29 Claims, No Drawings

WOVEN FLAME-RESISTANT GARMENT FABRIC, AND GARMENT MADE THEREFROM

CROSS-REFERENCE TO RELATED APPLICATIONS

This application is a continuation of U.S. patent Ser. No. 13/796,896 filed on Mar. 12, 2013, which application claims, pursuant to 35 U.S.C. § 119(e), the benefit of the filing date of U.S. Patent Application No. 61/716,163, which was filed on Oct. 19, 2012, both of which applications are herein incorporated by reference.

BACKGROUND OF THE INVENTION

The present invention relates to woven flame-resistant fabrics for apparel items.

Flame-resistant fabrics (also variously referred to as "fire-resistant", "flame-retardant", and "fire-retardant" fabrics) are fabrics that, once ignited, tend not to sustain a flame when the source of ignition is removed. A great deal of investigation and research has been directed toward the development and improvement of flame-resistant fabrics for use in various products such as bedding, clothing, and others. Flame-resistant clothing or apparel is often worn by workers involved in activities such as industrial manufacturing and processing, fire-fighting, electrical utility work, and other endeavors that entail a significant risk of being exposed to open flame and/or electrical arcs.

Flame-resistant fabrics include both fabrics that are treated to be flame-resistant as well as flame-resistant fabrics made from inherently flame-resistant fibers. The former types of fabrics are not themselves flame-resistant, but are made flame-resistant by applying to the fabric a chemical composition that renders the fabric resistant to flame. These types of fabrics are susceptible to losing their flame-resistance when laundered repeatedly because the flame-resistant composition tends to wash out or is rendered ineffective because of chemical reactions with laundering chemicals. In contrast, inherently flame-resistant fabrics do not suffer from this drawback because they are made from fibers that are themselves flame-resistant.

Various types of inherently flame-resistant (FR) fibers have been developed, including modacrylic fibers (e.g., PROTEX® modacrylic fibers from Kaneka Corporation of Osaka, Japan), aramid fibers (e.g., NOMEX® meta-aramid fibers and KEVLAR® para-aramid fibers, both from E. I. Du Pont de Nemours and Company of Wilmington, Del.), FR rayon fibers, oxidized polyacrylonitrile fibers, and others. It is common to blend one or more types of FR staple fibers with one or more other types of non-FR staple fibers to produce a fiber blend from which yarn is spun, the yarn then being knitted or woven into fabrics for various applications. In such a fiber blend, the FR fibers can render the blend flame-resistant even though some fibers in the blend may themselves be non-FR fibers, because when the FR fibers combust they release non-combustible gases that tend to displace oxygen and thereby extinguish any flame.

In the United States, it is desirable and often required for clothing worn by certain types of workers, such as petrochemical workers, to pass standard performance specification NFPA 2112-2012 ("Standard on Flame-Resistant Garments for Protection of Industrial Personnel Against Flash Fire"), Section 8.5 (Manikin Test), of the National Fire Protection Association. The NFPA standard is based on ASTM F1930, "Standard Test Method for Evaluation of Flame Resistant Clothing for Protection Against Fire Simulations Using an Instrumented Manikin." This standard sets various standard performance specifications for a fabric, among which are specifications for the ability of the fabric to limit the extent and severity of burns to the human body when covered in single-layer garments constructed of the fabric. The NFPA 2112 Section 8.5 test covers quantitative measurements and subjective observations that characterize the performance of single-layer garments or protective clothing ensembles mounted on a stationary instrumented manikin. The conditioned test specimen is placed on the instrumented manikin at ambient atmospheric conditions and exposed to a propane-air diffusion flame with controlled heat flux, flame distribution and duration. The average exposure heat flux is 84 $kW/m^2$ (2 $cal/s/cm^2$) with durations up to 20 seconds. The test procedure, data acquisition, calculation of results and preparation of parts of the test report are performed with computer hardware and software programs. Thermal energy transferred through and from the test specimen during and after the exposure is measured by thermal energy sensors. The sensors are located at the surface of the manikin. They are used to measure the thermal energy absorbed as a function of time over a preset time interval. A computer-based data acquisition system is used to store the time-varying output from the sensors. Computer software uses the stored data to calculate the heat flux and its variation with time at the surface of each sensor. The calculated heat flux and its variation with time at the surface is used to calculate the temperature within human skin and subcutaneous layers (adipose) as a function of time. The temperature history within the skin and subcutaneous layers (adipose) is used to predict the onset and severity of human skin burn injury. The computer software calculates the predicted second-degree and predicted third-degree burn injury and the total predicted burn injury resulting from the exposure. The overall percentage of predicted second-degree, predicted third-degree and predicted total burn injury is calculated by dividing the total number of sensors indicating each of these conditions by the total number of sensors on the manikin. Alternately, the overall percentages are calculated using sensor area-weighted techniques, in the case of facilities with non-uniform sensor coverage. A reporting is also made of the above conditions where the areas that are uncovered by the test specimen are excluded. This test method does not include the approximately 12% of body surface area represented by the unsensored manikin feet and hands. No corrections are applied for their exclusion. The performance of the test specimen is indicated by the calculated burn injury area and subjective observations of material response to the test exposure.

In the United States, it is desirable and often required for clothing worn by certain types of workers to pass standard performance specification F1506 of the American Society for Testing and Materials (ASTM). This standard, entitled "Standard Performance Specification for Flame Resistant Textiles Materials for Wearing Apparel for Use by Electrical Workers Exposed to Momentary Electrical Arc and Related Thermal Hazards", sets various standard performance specifications for a fabric, among which are specifications for the ability of the fabric to self-extinguish after being ignited. When the ignition source is removed, the fabric must self-extinguish in less than 2 seconds and have less than a 6-inch char length according to ASTM Test Method D6413 ("Standard Test Method for Flame Resistance of Textiles", also referred to as the Vertical Flame test).

The F1506 performance standard also includes standard test ASTM 1959 ("Standard Test Method for Determining the Arc Thermal Performance Value of Materials for Clothing"), which measures the level of protection that the fabric provides against electrical arc exposure. This test method measures the arc rating of materials that meet the flame-resistance requirements of less than 150 mm (6 inches) char length and less than 2 seconds afterflame when tested in accordance with ASTM D6413. The method determines the heat transport response through the fabric when exposed to heat energy from an electric arc. This heat transfer response is assessed versus the Stoll curve, which is an approximate human tissue tolerance predictive model that projects the onset of a second-degree burn injury. During the procedure, the amount of heat energy transferred by the tested material is measured, using copper slug calorimeters, during and after exposure to the electric arc. The arc rating (denoted the "ATPV") for the material is the amount of energy that predicts a 50% probability of second-degree burn as determined by the Stoll curve, or that causes the fabric to break open, whichever occurs first.

In addition to the above-noted performance specifications of fabrics, other properties are also important if a fabric is to be practical and commercially viable, particularly for clothing. For instance, the fabric should be durable under repeated industrial launderings and should have good abrasion-resistance. Furthermore, the fabric should be readily dyeable to dark, solid shades of color, and should be comfortable to wear. The fabric should have good dimensional stability and resistance to seam slippage.

As noted above, there are various fabrics that purport to provide some degree of flame-resistance. However, the prior art known to the applicant does not disclose or suggest the specific fabric of the present invention, which has been found to possess distinct advantages and characteristics, including passage of the NFPA 2112 Section 8.5 Manikin Test. The fabric is also comfortable to wear, is abrasion-resistant, and is durable under repeated industrial launderings.

BRIEF SUMMARY OF THE INVENTION

More particularly, the present invention provides a woven flame-resistant fabric for garments. The fabric comprises warp yarns that extend in a longitudinal or warp direction and fill yarns that extend in a width direction of the fabric, the warp and fill yarns comprising at least about 30 wt. % inherently flame-resistant fibers. The fabric is woven from a plurality of warp yarn groups consecutively arranged across the width direction in a recurring pattern, each warp yarn group consisting of a plurality of adjacent consecutively arranged warp yarns. At least one warp yarn in each warp yarn group is woven with the fill yarns in a plain (1/1) weave and at least one warp yarn in each warp yarn group is woven with the fill yarns in one or more non-plain weaves each selected from the group consisting of 1/2, 2/1, 2/2, 1/3, and 3/1. Approximately half of the warp yarns in the fabric are woven with the fill yarns in a plain (1/1) weave and the remaining warp yarns in the fabric are woven with the fill yarns in said one or more non-plain weaves, in an alternating fashion.

A minimum content of about 30 wt. % of inherently flame-resistant fibers in the fabric is generally considered necessary in order to meet applicable standards for protection against electrical arcs, per ASTM F1959 testing.

A minimum content of about 45 wt. % of inherently flame-resistant fibers in the fabric is generally considered necessary in order to meet applicable standards for protection against flash fires, per NFPA-2112 manikin testing.

In preferred embodiments, the maximum number of adjacent plain-woven warp yarns in the fabric is 2. In some embodiments, there are no multiple adjacent plain-woven warp yarns.

The alternating plain/non-plain weave pattern has been found to be effective to increase the air permeability of the fabric relative to a plain-woven fabric that is otherwise identical (i.e., made from the same warp yarns and fill yarns and having the same basis weight), yet the performance of the fabric in the NFPA 2112 manikin test equals or exceeds that of the plain-woven version of the fabric. In one embodiment, for example, a fabric made in accordance with the invention was tested to have an air permeability approximately 22% higher than the plain-woven version of the fabric, but the NFPA-2112 manikin test result indicated a 33% body burn for the inventive fabric, versus 44% for the plain-woven version. In another embodiment, a higher-weight fabric in accordance with the invention had an air permeability approximately 80% higher than the plain-woven version, but the manikin test result indicated a 13% body burn for the inventive fabric, versus a 22% body burn for the plain-woven version. Thus, a more-breathable (and therefore more-comfortable) flame-resistant garment can be constructed from the fabric and the garment can still provide the same or superior performance in the manikin test.

In some embodiments of the invention, each warp yarn group consists of 4 warp yarns. Various weave patterns using the 4-yarn grouping are possible in accordance with the invention. In some embodiments, the warp yarn group consists of 2 plain-woven warp yarns alternating with 2 non-plain-woven warp yarns. A subset of these embodiments has the warp yarn group consisting of a plain-woven warp yarn, followed by a 1/2 woven warp yarn, followed by a plain-woven warp yarn, followed by a 2/1 woven warp yarn.

Advantageously, the fabric can have a weight of about 4 oz/yd$^2$ to about 10 oz/yd$^2$, or about 4 oz/yd$^2$ to about 7.5 oz/yd$^2$, or about 4.5 oz/yd$^2$ to about 6 oz/yd$^2$, depending on the application.

Fabric made in accordance with the invention has an air permeability measured in accordance with ASTM D737 that is at least about 20% greater than that of a comparable plain-woven fabric constructed from the identical warp and fill yarns and having the same weight in oz/yd$^2$. For example, the air permeability can be about 20% to about 80% greater than that of the plain-woven version. The fabric in accordance with the invention also tends to be thicker than the plain-woven version of the fabric.

In some embodiments of the invention, the warp yarns are all identical to each other, and the fill yarns are all identical to each other. In some of those embodiments, the warp yarns are identical to the fill yarns.

In other embodiments, multiple types of warp yarns can be used, and/or multiple types of fill yarns can be used, where the "type" of yarn can refer to the material of which the yarn is made and/or the size of the yarn and/or the method of spinning used for spinning the yarn from staple fibers and/or any other physical characteristic of the yarn.

Yarns of various fiber makeups can be used for the warp and fill yarns. In preferred embodiments, the warp and fill yarns comprise about 30 wt. % to about 100 wt. % aramid fibers, more preferably about 45 wt. % to about 100 wt. % aramid fibers.

DETAILED DESCRIPTION OF EXAMPLE EMBODIMENTS

The present inventions now will be described more fully hereinafter with reference to particular embodiments and examples of the inventions. However, these inventions may be embodied in many different forms and should not be construed as limited to the embodiments set forth herein; rather, these embodiments are provided so that this disclosure will satisfy applicable legal requirements.

EXAMPLES

Samples were made of a number of fabrics having various weave constructions, including various alternating plain/non-plain weaves and "control" versions of plain-woven fabrics for comparison purposes. Most of the fabrics were made to a nominal weight of 4.5 oz/yd$^2$, but one alternating plain/non-plain weave was made in a nominal 6 oz/yd$^2$ weight (together with a "control" version of plain weave in that weight). All of the fabrics were woven from warp and fill yarns that were all identical to one another, spun from NOMEX® 462 staple fiber blend, which is a blend of 93 wt. % NOMEX®, 5 wt. % KEVLAR®, and 2 wt. % P140 (a static dissipative fiber). The nominal 4.5 oz/yd$^2$ fabrics were woven from 36/2 yarns, and the nominal 6 oz/yd$^2$ fabrics were woven from 30/2 yarns. The fabrics were dyed and finished and were then subjected to a number of tests to assess various properties of the fabrics. Physical characteristics of the various fabrics are listed in Table I below:

TABLE I

Physical Characteristics of the Tested Fabrics

| | Finished Width[1] (in) | Weight[2] (osy) | Air Permeablility[3] cfm |
|---|---|---|---|
| Version 1 2/2:2/2:2/2:3/1 39 PPI | 57.8 | 4.6 | 397 |
| Version 2 1/1:2/2:1/1:2/2 39 PPI | 55.0 | 4.6 | 368 |
| Version 3 1/1:2/1:1/1:1/2 39 PPI | 61.0 | 4.1 | 378 |
| Version 3 1/1:2/1:1/1:1/2 40 PPI | 59.0 | 4.5 | 311 |
| Version 3B 1/1:1/1:2/1:1/2 40 PPI | 61.0 | 4.4 | 393 |
| Version 4 1/1:2/2:1/1:3/1 39 PPI | 59.8 | 4.3 | 391 |
| Version 5 1/1:2/2:1/1:3/1 44 PPI | 59.0 | 4.7 | 288 |
| Control - Plain Weave 4.5 osy | 60.8 | 4.5 | 254 |
| Version 3 1/1:2/1:1/1:1/2 6 osy | 58.5 | 6.0 | 169 |
| Control - Plain Weave 6 osy | 60.8 | 5.8 | 94 |

[1]ASTM D3774
[2]ASTM D3776C
[3]ASTM D737
NT = not tested

The Version 1 fabric was woven with a repeating 4-warp yarn weave pattern of 2/2:2/2:2/2:3/1. This notation means that the four consecutive warp yarns in the group were woven with the fill yarns as follows: Yarn #1 through yarn #3 were each woven over two fill yarns and under the next two fill yarns, etc. Yarn #4 was woven over three fill yarns and under the next fill yarn, etc.

The Version 2 fabric was woven with a repeating 4-warp yarn weave pattern of 1/1:2/2:1/1:2/2.

The Version 3—39 PPI (picks per inch) fabric was woven with a repeating 4-warp yarn weave pattern of 1/1:2/1:1/1:1/2.

The Version 3—40 PPI fabric was woven with a repeating 4-warp yarn weave pattern of 1/1:2/1:1/1:1/2.

The Version 3B fabric was woven with a repeating 4-warp yarn weave pattern of 1/1:1/1:2/1:1/2.

The Version 4 fabric was woven with a repeating 4-warp yarn weave pattern of 1/1:2/2:1/1:3/1 (39 PPI).

The Version 5 fabric was woven with a repeating 4-warp yarn weave pattern of 1/1:2/2:1/1:3/1 (44 PPI).

The various fabrics were subjected to a number of tests to assess different aspects of their performance as relevant to fire-resistant garments constructed from such fabrics. Air permeability of the fabrics was measured in accordance with the ASTM D737 test method. In this test, the rate of air flow passing perpendicularly through a known area of fabric is adjusted to obtain a prescribed pressure differential between the two fabric surfaces. From this rate of air flow, the air permeability of the fabric is determined.

Dimensional stability was measured in accordance with the AATCC (American Association of Textile Chemists and Colorists) 135 test protocol. This test method is intended for the determination of dimensional changes of fabrics when subjected to home laundering procedures used by consumers. The dimensional changes of fabric specimens subjected to home laundering care are measured using pairs of bench marks applied to the fabric before laundering. The dimensional changes in both warp and fill directions are measured and expressed in terms of percent change relative to before laundering.

Tear strength of the fabrics was measured in accordance with the ASTM D1424 test method. This test method covers the determination of the force required to propagate a single-rip tear starting from a cut in a fabric and using a falling-pendulum (Elmendorf-Type) apparatus.

Seam slippage of the fabrics was measured in accordance with the ASTM D434 test method. This test method covers the determination of the resistance to slippage of filling yarns over warp yarns, or warp yarns over filling yarns, using a standard seam.

Random tumble pilling of the fabrics was measured in accordance with the ASTM D3512 test method. This test method covers the resistance to the formation of pills and other related surface changes on textile fabrics using the random tumble pilling tester. The test specimens were tumbled for 30 minutes and were then evaluated, and were then tumbled for an additional 30 minutes and were evaluated again.

Flame resistance of the fabrics was measured using the ASTM D6413 test method. This test method is used to measure the vertical flame resistance of textiles. This test method determines the response of textiles to a standard ignition source, deriving measurement values for afterflame time and char length. The specimen is kept in a static, draft-free, vertical position and does not involve movement except that resulting from the exposure.

The NFPA 2112-2012 (Section 8.5) Manikin Test method (based on ASTM F1930) was used to measure the relative degree of protection against flash fire conditions, as previously described. Not all of the fabric specimens were tested with the manikin test.

Arc thermal performance was measured for certain (but not all) fabric samples, in accordance with the ASTM F1959 test method. This test method is used to measure the arc rating of materials intended for use as flame-resistant clothing for workers exposed to electric arcs that would generate heat flux rates from 84 to 25 120 kW/m$^2$ [2 to 600 cal/cm$^2$s]. This test method maintains the specimen in a static, vertical position and does not involve movement except that resulting from the exposure.

Thermal shrinkage of the fabrics was measured in accordance with the NFPA 2112-2012 test method.

Tables II and III below show the results of the tests described above, for the various fabric specimens.

TABLE II

Test Results for the Fabrics

| | Tear Strength lbf, W × F | Dimensional Stability %, W × F | Seam Slippage lbf, W × F | Random Tumble Pilling, 30 min | Random Tumble Pilling, 60 min |
|---|---|---|---|---|---|
| Version 1 2/2:2/2:2/2:3/1 39 PPI | NT | 3.2 × 1.5 | NT | 2.9 | 2.0 |
| Version 2 1/1:2/2:1/1:2/2 39 PPI | NT | 2.8 × 3.5 | NT | 3.5 | 2.0 |
| Version 3 1/1:2/1:1/1:1/2 39 PPI | NT | 2.3 × 5.3 | 27 × 50 | 2.5 | 2.5 |
| Version 3 1/1:2/1:1/1:1/2 40 PPI | 26.8 × 17.3 | 2.1 × 2.9 | 44 × 43 | 4.0 | 3.3 |
| Version 3B 1/1:1/1:2/1:1/2 40 PPI | 28.0 × 25.4 | 2.1 × 2.6 | 15 × 43 | 4.3 | 2.5 |
| Version 4 1/1:2/2:1/1:3/1 39 PPI | NT | 1.1 × 2.0 | 34 × 19 | 4.5 | 2.0 |
| Version 5 1/1:2/2:1/1:3/1 44 PPI | 23.3 × 20.7 | 1.1 × 5.3 | 59 × 52 | 2.5 | 3.0 |
| Control - Plain Weave 4.5 osy | 12.4 × 8.5 | 1.8 × 1.8 | (≥30) | (≥3.0) | (≥2.5) |
| Version 3 1/1:2/1:1/1:1/2 6 osy | 27.2 × 19.7 | 2.2 × 2.9 | 55 × 48 | 3.5 | 4.0 |
| Control - Plain Weave 6 osy | 13.5 × 10.5 | 1.6 × 2.7 | 40 × 43 | (≥3.0) | (≥2.5) |

TABLE III

Test Results for the Fabrics

| | Flame Resistance Afterflame sec, W × F | Flame Resistance Char Length in, W × F | Thermal Shrinkage %, initial W × F | Thermal Shrinkage %, after 3 washes W × F | Manikin Test % body burn |
|---|---|---|---|---|---|
| Version 1 2/2:2/2:2/2:3/1 39 PPI | NT | NT | 0.3 × 0.5 | NT | NT |
| Version 2 1/1:2/2:1/1:2/2 39 PPI | NT | NT | 1.2 × 0.2 | NT | NT |
| Version 3 1/1:2/1:1/1:1/2 39 PPI | 0.0 × 0.0 | 2.8 × 2.6 | NT | NT | NT |
| Version 3 1/1:2/1:1/1:1/2 40 PPI | 0.2 × 0.2 | 2.4 × 2.5 | 1.7 × 2.8 | 0.3 × 1.3 | 33 |
| Version 3B 1/1:1/1:2/1:1/2 40 PPI | NT | NT | 1.3 × 2.5 | NT | NT |
| Version 4 1/1:2/2:1/1:3/1 39 PPI | 0.0 × 0.0 | 2.6 × 2.4 | NT | NT | NT |

TABLE III-continued

| Test Results for the Fabrics | | | | | |
|---|---|---|---|---|---|
| | Flame Resistance Afterflame sec, W × F | Flame Resistance Char Length in, W × F | Thermal Shrinkage %, initial W × F | Thermal Shrinkage %, after 3 washes W × F | Manikin Test % body burn |
| Version 5 1/1:2/2:1/1:3/1 44 PPI | 0.0 × 0.0 | 2.2 × 2.3 | NT | NT | NT |
| Control - Plain Weave 4.5 osy | 0.0 × 0.0 | 2.4 × 2.3 | 1.7 × 2.8 | 0.5 × 0.8 | 44 |
| Version 3 1/1:2/1:1/1:1/2 6 osy | 0.0 × 0.0 | 2.7 × 2.5 | 2.0 × 2.0 | 1.0 × 1.0 | 13 |
| Control - Plain Weave 6 osy | 0.0 × 0.0 | 2.2 × 2.0 | 0.6 × 1.3 | 0.5 × 0.6 | 22 |

Arc thermal performance value (ATPV) was determined to be 5.2 cal/cm$^2$ for the Version 3 (40 PPI) 4.5 oz/yd$^2$ fabric, and 4.1 cal/cm$^2$ for the plain-woven version of the 4.5 oz/yd$^2$ fabric. Arc thermal performance value (ATPV) was determined to be 6.4 cal/cm$^2$ for the Version 3 6.0 oz/yd$^2$ fabric, and 6.8 cal/cm$^2$ for the plain-woven version of the 6.0 oz/yd$^2$ fabric.

Based on the test results as summarized above, a number of conclusions were reached. Version 1 was deemed to be unsatisfactory because of unacceptable pilling performance. Version 2 was non-preferred because of unsatisfactory dimensional stability and appearance. Version 3 (39 PPI) was lower in weight (4.1 oz/yd$^2$) than the 4.5 oz/yd$^2$ target. Versions 3B and 4 had unsatisfactory seam slippage (too low). Version 5 had unsatisfactory dimensional stability. Thus, of the tested fabrics, Version 3 (40 PPI) was deemed to be most-preferred.

The Version 3 (40 PPI) 4.5 oz/yd$^2$ fabric and the plain-weave version thereof were then further tested in the NFPA 2112-2012 (Section 8.5) Manikin Test to determine if the significantly higher air permeability of the inventive fabric (311 cfm, versus 254 cfm for the plain-woven fabric) would impair its performance in the manikin test. As indicated in Table III above, surprisingly, the inventive fabric achieved better performance than the less-permeable plain-woven fabric (33% body burn for the inventive fabric, versus 44% for the plain-woven fabric). Similarly, comparing the Version 3 6.0 oz/yd$^2$ fabric and the plain-weave version thereof, air-permeability of the inventive fabric was about 80% greater than that of the plain-weave version, yet the inventive fabric had a 13% body burn versus 22% for the plain-weave. These results ran contrary to the expectation that increasing the air permeability of a fabric (all else being equal) should impair the manikin test performance, as intuition would suggest that a more-open fabric should be a poorer heat barrier than a less-open fabric. The results are not fully understood, but it is theorized that the inventive fabric having the alternating plain/non-plain weave pattern exhibits an effective thickness that is greater than the plain-weave version, as a result of differential shrinkage of the ends, and thus traps more air within the fabric than does the plain-weave version. This presumably gives the fabric the better manikin test performance that was noted in the test results. Applicant points out, however, that this explanation is merely a hypothesis that would require further testing in order to confirm.

A further benefit of the inventive fabric versus a comparable plain-weave fabric is a substantial increase (a near doubling, in the fabrics tested) in tear strength.

All of the tested fabrics were woven from yarns spun from NOMEX® 462 staple fiber blend (which, when woven into fabric, is designated NOMEX IIIA). However, the invention is not limited to any particular fiber or fiber blend. It is believed that adopting the alternating plain/non-plain weave pattern of the present invention should provide beneficial properties generally as noted here, with yarns spun from other fiber blends. Various fiber blends are possible in the practice of the invention. Types of fibers that may be usable in fabrics made in accordance with the invention include aramid fibers (e.g., NOMEX® meta-aramid fibers and KEVLAR® para-aramid fibers, both from E. I. Du Pont de Nemours and Company), modacrylic fibers (e.g., PROTEX® modacrylic fibers from Kaneka Corporation), polybenzimidazole fibers (e.g., PBI® fibers from PBI Performance Products, Inc.), polyimide fibers (e.g., P84® fibers from Evonik Industries), polyphenylene benzobisoxazole fibers (e.g., ZYLON® fibers from Toyobo Corporation), melamine fibers (e.g., Basofil® fibers from Basofil Fibers, LLC), phenol-aldehyde (novaloid) fibers (e.g., KYNOL™ fibers from American Kynol, Inc.), FR polyacrylonitrile fibers, oxidized polyacrylonitrile fibers, polysulfonamide (PSA) fibers, polyamide-imide fibers, carbon fibers, FR rayon fibers (e.g., LENZING FR® from Lenzing AG), FR nylon fibers (e.g., Nexylon FR fibers from EMS GRILTECH), FR polyester fibers, cotton fibers, nylon fibers, viscose fibers, lyocell fibers (e.g. TENCEL® fibers from Lenzing AG), wool fibers, anti-static fibers (e.g., P-140 fibers from E.I. Du Pont de Nemours and Company), and others.

One fiber blend useful in the practice of the invention comprises or consists of about 90 to 95 wt. % meta-aramid (e.g., NOMEX®) fibers, about 2 to 8 wt. % para-aramid (e.g., KEVLAR®) fibers, and about 1 to 3 wt. % anti-static (e.g., P140) fibers.

A fiber blend useful in some embodiments of the invention comprises or consists of about 30 to 90 wt. % modacrylic fibers, about 5 to 65 wt. % aramid fibers, and about 0 to 5 wt. % anti-static fibers.

Another fiber blend useful in some embodiments of the invention comprises or consists of about 40 to 80 wt. % modacrylic fibers, about 15 to 55 wt. % aramid fibers, and about 1 to 4 wt. % anti-static fibers.

Another fiber blend useful in some embodiments of the invention comprises or consists of about 50 to 70 wt. % modacrylic fibers, about 25 to 45 wt. % aramid fibers, and about 2 to 3 wt. % anti-static fibers.

A further fiber blend useful in some embodiments of the invention comprises or consists of about 10 to 70 wt. % modacrylic fibers, about 20 to 80 wt. % cellulosic (e.g., lyocell) fibers, and about 0 to 40 wt. % para-aramid fibers.

Yet another fiber blend useful in some embodiments of the invention comprises or consists of about 20 to 60 wt. % modacrylic fibers, about 30 to 70 wt. % cellulosic (e.g., lyocell) fibers, and about 0 to 30 wt. % para-aramid fibers.

A still further fiber blend useful in some embodiments of the invention comprises or consists of about 30 to 50 wt. % modacrylic fibers, about 40 to 60 wt. % cellulosic (e.g., lyocell) fibers, and about 5 to 20 wt. % para-aramid fibers.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A woven flame-resistant garment fabric, the fabric comprising warp yarns that extend in a longitudinal or warp direction and fill yarns that extend in a width direction of the fabric, the warp and fill yarns comprising at least about 30 wt. % inherently flame-resistant fibers, the fabric being a single-layer fabric woven from a plurality of warp yarn groups consecutively arranged across the width direction in a recurring pattern, each warp yarn group consisting of a plurality of adjacent consecutively arranged warp yarns, wherein at least one warp yarn in each warp yarn group is woven with the fill yarns in a plain (1/1) weave and at least one warp yarn in each warp yarn group is woven with the fill yarns in one or more non-plain weaves each selected from the group consisting of 1/2, 2/1, 2/2, 1/3, and 3/1, and wherein approximately half of the warp yarns in the fabric are woven with the fill yarns in a plain (1/1) weave and the remaining warp yarns in the fabric are woven with the fill yarns in said one or more non-plain weaves, in an alternating fashion.

2. The woven flame-resistant garment fabric of claim 1, wherein the maximum number of adjacent plain-woven warp yarns in the fabric is 2.

3. The woven flame-resistant garment fabric of claim 1, wherein the fabric has both 1/2 woven warp yarns and 2/1 woven warp yarns.

4. The woven flame-resistant garment fabric of claim 1, wherein each warp yarn group consists of 4 warp yarns.

5. The woven flame-resistant garment fabric of claim 4, wherein the fabric is devoid of any multiple adjacent plain-woven warp yarns.

6. The woven flame-resistant garment fabric of claim 5, wherein the warp yarn group consists of 2 plain-woven warp yarns alternating with 2 non-plain-woven warp yarns.

7. The woven flame-resistant garment fabric of claim 6, wherein the warp yarn group consists of a plain-woven warp yarn, followed by a 1/2 woven warp yarn, followed by a plain-woven warp yarn, followed by a 2/1 woven warp yarn.

8. The woven flame-resistant garment fabric of claim 6, wherein the fabric has a weight of about 4 oz/yd$^2$ to about 10 oz/yd$^2$.

9. The woven flame-resistant garment fabric of claim 6, wherein the fabric has a weight of about 4 oz/yd$^2$ to about 7.5 oz/yd$^2$.

10. The woven flame-resistant garment fabric of claim 6, wherein the fabric has a weight of about 4.5 oz/yd$^2$ to about 6 oz/yd$^2$.

11. The woven flame-resistant garment fabric of claim 1, wherein the fabric has an air permeability measured in accordance with ASTM D737 that is at least about 20% greater than that of a comparable plain-woven fabric constructed from the identical warp and fill yarns and having the same weight in oz/yd$^2$.

12. The woven flame-resistant garment fabric of claim 1, wherein the warp yarns are all identical to each other, and the fill yarns are all identical to each other.

13. The woven flame-resistant garment fabric of claim 12, wherein the warp yarns are identical to the fill yarns.

14. The woven flame-resistant garment fabric of claim 13, wherein the warp and fill yarns comprise about 30 wt. % to about 100 wt. % aramid fibers.

15. The woven flame-resistant garment fabric of claim 14, wherein the warp and fill yarns comprise about 45 wt. % to about 100 wt. % aramid fibers.

16. A garment constructed from the woven flame-resistant garment fabric of claim 1.

17. A woven flame-resistant garment fabric, the fabric comprising warp yarns that extend in a longitudinal or warp direction and fill yarns that extend in a width direction of the fabric, the warp and fill yarns comprising at least about 30 wt. % inherently flame-resistant fibers, the fabric being a single-layer fabric woven such that approximately half of the warp yarns are woven with the fill yarns in a plain (1/1) weave and the remaining warp yarns are woven with the fill yarns in one or more non-plain weaves each selected from the group consisting of 1/2, 2/1, 2/2, 1/3, and 3/1, in an alternating fashion, wherein the fabric has a weight of about 4 oz/yd$^2$ to about 7.5 oz/yd$^2$, and wherein the fabric has an air permeability measured in accordance with ASTM B737 that is at least about 20% greater than that of a comparable plain-woven fabric constructed from the identical warp and fill yarns and of equal weight in oz/yd$^2$.

18. The woven flame-resistant garment fabric of claim 17, wherein the warp yarns are all identical to each other, and the fill yarns are all identical to each other.

19. The woven flame-resistant garment fabric of claim 18, wherein the warp yarns are identical to the fill yarns.

20. The woven flame-resistant garment fabric of claim 19, wherein the warp and fill yarns comprise about 30 wt. % to about 100 wt. % aramid fibers.

21. The woven flame-resistant garment fabric of claim 20, wherein the warp and fill yarns comprise about 45 wt. % to about 100 wt. % aramid fibers.

22. The woven flame-resistant garment fabric of claim 17, comprising about 90 to 95 wt. % meta-aramid fibers, about 2 to 8 wt. % para-aramid fibers, and about 1 to 3 wt. % anti-static fibers.

23. The woven flame-resistant garment fabric of claim 17, comprising about 30 to 90 wt. % modacrylic fibers, about 5 to 65 wt. % aramid fibers, and about 0 to 5 wt. % anti-static fibers.

24. The woven flame-resistant garment fabric of claim 17, comprising about 40 to 80 wt. % modacrylic fibers, about 15 to 55 wt. % aramid fibers, and about 1 to 4 wt. % anti-static fibers.

25. The woven flame-resistant garment fabric of claim 17, comprising about 50 to 70 wt. % modacrylic fibers, about 25 to 45 wt. % aramid fibers, and about 2 to 3 wt. % anti-static fibers.

26. The woven flame-resistant garment fabric of claim 17, comprising about 10 to 70 wt. % modacrylic fibers, about 20 to 80 wt. % cellulosic fibers, and about 0 to 40 wt. % para-aramid fibers.

27. The woven flame-resistant garment fabric of claim 17, comprising about 20 to 60 wt. % modacrylic fibers, about 30 to 70 wt. % cellulosic fibers, and about 0 to 30 wt. % para-aramid fibers.

28. The woven flame-resistant garment fabric of claim 17, comprising about 30 to 50 wt. % modacrylic fibers, about 40 to 60 wt. % cellulosic fibers, and about 5 to 20 wt. % para-aramid fibers.

29. A garment constructed from the woven flame-resistant garment fabric of claim 17.

* * * * *